United States Patent [19]

Formica

[11] 4,397,326

[45] Aug. 9, 1983

[54] ROTATABLE MASCARA APPLICATOR

[76] Inventor: Val A. Formica, 5 Doherty Dr., Middletown, N.J. 07748

[21] Appl. No.: 360,740

[22] Filed: Mar. 22, 1982

[51] Int. Cl.[3] ..... A45D 40/30

[52] U.S. Cl. ..... 132/88.5; 132/88.7

[58] Field of Search ..... 132/88.5, 88.7, 79, 132/85; 401/121, 122, 126, 129

[56] References Cited

U.S. PATENT DOCUMENTS 576,187 2/1897 Eaton ..... 401/121

3,073,320 1/1963 Seaver ..... 401/121

*Primary Examiner*—G. E. McNeill

*Attorney, Agent, or Firm*—Steele, Gould & Fried

[57] ABSTRACT

A rotatable mascara applicator is provided which delivers substantially more mascara to eyelashes than prior art brushes and includes a handle member, a mascara brush and means for rotatably mounting the mascara brush to the handle member so that the brush rotates upon application of mascara to eyelashes.

7 Claims, 6 Drawing Figures

10
12
16
22
20
18
14

12
10
30
28
22
26
32
16
24
20
18
14

ROTATABLE MASCARA APPLICATOR

FIELD OF THE INVENTION

The present invention relates to a rotatable mascara brush which is made to rotate by the action of brushing mascara on to an eyelash.

BACKGROUND OF THE INVENTION

Mascara is normally applied to the eyelash of the user by means of a bristle carrying wand or brush which transfers the cosmetic from its container to the eyelash. Typically, the brush is formed of a handle portion and an integrally connected head or brush portion which carries a series of immobile non-rotatable bristles arranged in spiral or helical formation.

Unfortunately, it has been found that where conventional mascara brushes are used, only a relatively small amount of mascara may be applied with each application. Thus, the user must apply the mascara in several applications making it exceedingly difficult to obtain even application of the mascara.

U.S. Pat. No. 4,056,111 to Mantelet discloses a cosmetic applicator, particularly for eyelashes, which includes a hand-held casing supporting a motor-driven rotatable output shaft which carries a cylindrical brush. The motor may be a clockwork motor or an electric battery powered motor.

U.S. Pat. No. 4,165,755 to Cassai discloses a mascara wand which includes a shaft extension which is pivotally secured to a main shaft; the shaft extension carries the mascara brush.

BRIEF DESCRIPTION OF THE INVENTION

In accordance with the present invention, a rotary mascara applicator is provided which overcomes disadvantages associated with prior art applicators in that the user may apply substantially more mascara to the eyelash in a single application than with prior art applicators. In addition, since substantially less applications are required, the mascara may be more evenly applied when using the rotary mascara applicator of the invention as compared to using prior art applicators.

The rotary mascara applicator of the invention includes a handle member, a mascara brush which includes a shaft and a plurality of bristles extending from one end of the shaft, and means for rotatably connecting the mascara brush to the handle member. Such means is comprised of a housing which includes a first bore which is slightly larger than the shaft of the brush and a second bore which defines an internal area which connects with, but is larger than, the first bore. A second end of the shaft of the brush, which end does not include bristles, passes through the first bore and terminates in the internal area of the housing. The means for rotatably connecting the brush to the handle member also includes rotation permitting means which is rotatably disposed and retained in the internal area of the housing and is fixedly connected to the end of the shaft which terminates in such internal area.

Upon brushing an eyelash with the rotary mascara applicator of the invention, the mascara brush including its shaft and the rotation permitting means are caused to rotate 360° in either direction.

BRIEF DESCRIPTION OF THE INVENTION

DETAILED DESCRIPTION OF THE INVENTION

Figure 1:
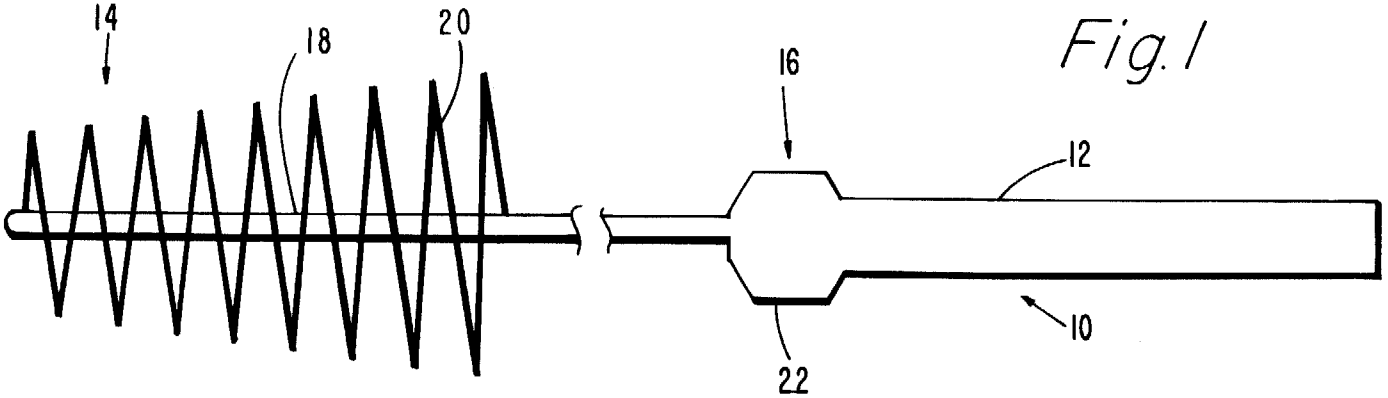
FIG. 1 is a side elevational view of a preferred embodiment of the rotary mascara applicator of the invention.
Figure 2:
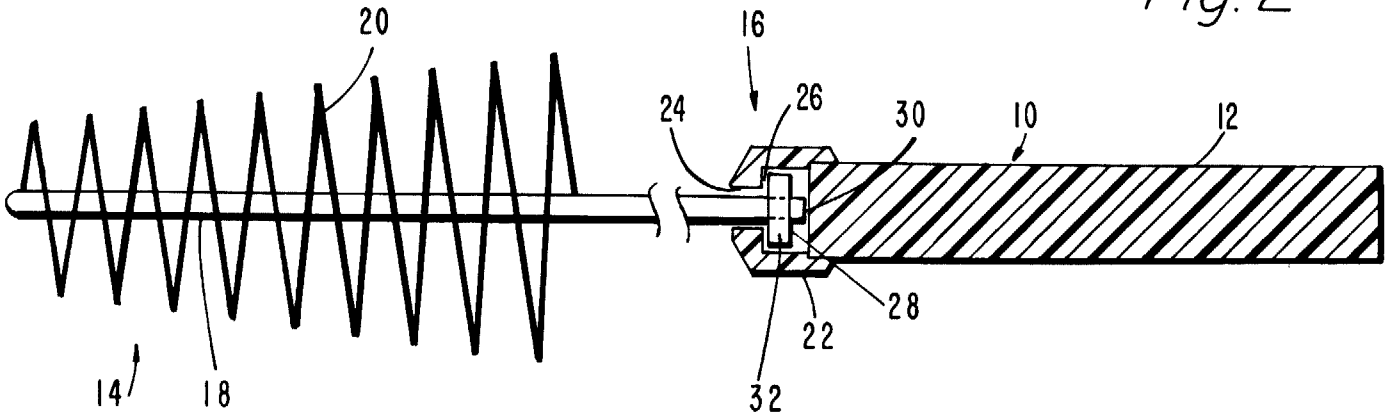
FIG. 2 is a partially cutaway view of the rotary mascara applicator shown in FIG. 1.
Figure 3:
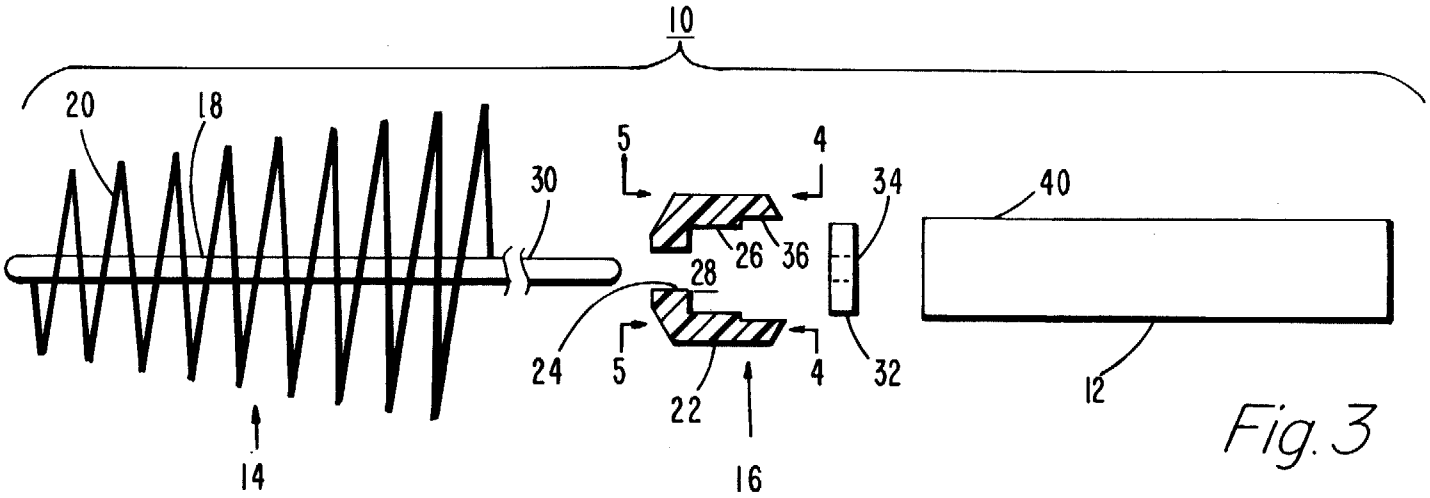
FIG. 3 is an exploded view of the rotary mascara applicator shown in FIGS. 1 and 2.
Figure 6:
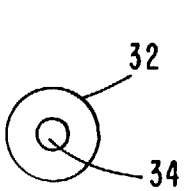
FIG. 6 is a front view of the rotation permitting means shown in FIG. 3.
Figure 5:
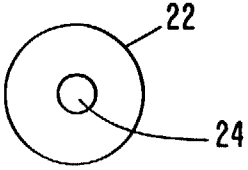
FIG. 5 is a rear view of the housing shown in FIG. 3 taken along lines 5—5 thereof.
Figure 4:
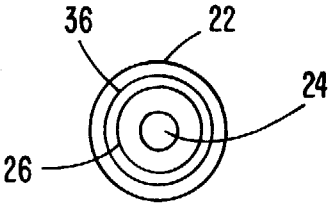
FIG. 4 is a front view of the housing shown in FIG. 3 taken along lines 4—4 thereof.

Referring to the Figures wherein like numerals represent like parts in the several views, Figures 1–6 illustrate a preferred embodiment of the rotary mascara applicator of the invention which is generally identified by the numeral 10. The applicator 10 includes a handle member 12; a mascara brush generally identified by the numberal 14 which includes a shaft 18 one portion of which carries bristles 20 which are spirally and/or helically attached to the shaft 18; and means for rotatably connecting brush 14 to the handle 12, which means are generally identified by the numeral 16 and best shown in FIGS. 2–6. The means 16 is formed of a housing 22 which includes a first bore 24 which is slightly larger in cross-section than the shaft 18 of the brush 14 and a second bore 26 (shown in FIGS. 3 and 4) which defines an internal area 28 which communicates with the first bore 24 as seen in FIG. 2. An end 30 of the shaft 18 of the brush 14 passes through the first bore 24 and terminates in the internal area 28 of the housing.

Rotation permitting means in the form of ring 32 which includes central opening 34 is fixedly connected to the end 30 of shaft 18 and is rotatably disposed in the internal area 28 of the housing 22 as shown best in FIG. 2. The inner walls of the housing 22 serve to retain the ring 32 in the internal area 28 thereof. The rotary mascara application of the invention also includes handle engaging means which, as shown, preferably take the form of a third bore 36 which is recessed from the internal area. The handle member 12 is adapted to snap fit in the third bore of recessed area 36 as best shown in FIGS. 1 and 2.

The rotary mascara application as shown in the Figures is easily assembled by first inserting the ring 32 into the housing so that it is disposed within the internal area 28 thereof; the end 30 of shaft 18 is then passed through bore 24 of the housing 22 and into the internal area 28 and is snapped into the opening 34 of the ring 32 and thereby retained in the internal area 28. The final step of assembly is to force the end 40 of handle member 12 into the bore 36 of the housing 22.

As will now be appreciated, upon applying mascara with the brush shown in the Figures, contact of the brush 14 with the eyelash causes the shaft 18 and ring 32 to rotate as a unit 360° in either direction.

Although in the preferred embodiment of the invention the end 30 of shaft 18 of the brush 14 is made to force fit into the ring 32 and the end 40 of the handle member 12 is made to force fit into the bore 36 of the housing 22, an adhesive may be used to fixedly connect these parts to each other. However, regardless of the means employed in attaining structural integrity, the ring 32 and shaft 18 will always rotate as a unit so that there will be enough clearance between the ring 32 and the bore 26 defined in the internal area 28 and between the shaft 18 and the bore 24 to allow free and easy rotation of the brush as desired.

In alternate embodiments, it will be appreciated that the rotation permitting means may take the form of a solid member as opposed to a ring, in which case, the end 30 of shaft 18 may be simply bonded to such solid member.

All of the above embodiments of the rotary mascara applicator of the invention are capable of applying substantially more mascara to an eyelash during the first application than prior art applicators so that the total number of applications required is reduced. In addition, the applicator of the invention applies mascara more evenly than prior art applicators.

What is claimed is:

1. A rotary mascara applicator comprising, in combination, a handle member;

a mascara brush including a shaft and a plurality of bristles extending from a portion of said shaft;

a housing a portion of which is connected to said handle member, internal walls of said housing defining a first bore slightly larger in cross-section than said shaft and a second bore defining an internal area connecting with but larger than said first bore, an end of said shaft of said brush passing through said first bore and terminating in said internal area; and rotation permitting means fixedly connected to said end of said shaft and rotatably disposed in said internal area of said housing, the inner walls of said housing serving to retain said rotation permitting means in said internal area, whereby brushing eyelashes with said brush causes said brush including said shaft and said rotation permitting means connected thereto to rotate 360° in either direction.

2. The applicator as defined in claim 1 wherein said rotation permitting means is comprised of a circular member adapted to rotate within said open area of said housing.

3. The applicator as defined in claim 2 wherein said circular member includes a central opening concentric with said first bore and adapted to receive said end of said shaft.

4. The applicator as defined in claim 3 wherein said end of said shaft is in a forced fit with said circular member.

5. The applicator as defined in claim 2 wherein said end of said shaft is bonded to said circular member.

6. The applicator as defined in claim 1 wherein said internal walls of said housing define a recessed area which stops short of said rotation permitting means, said handle member being adapted to snap fit in said recessed area.

7. The applicator as defined in claim 1 wherein said internal walls of said housing include a third bore recessed from said internal area and defining handle engaging means.

* * * * *